US005847744A

United States Patent [19]

Hoki et al.

[11] Patent Number: 5,847,744

[45] **Date of Patent: *Dec. 8, 1998**

[54] THIN-FILM THERMAL PRINT HEAD AND METHOD OF PRODUCING SAME

[75] Inventors: Hideaki Hoki; Toshihiko Takakura; Haruhiko Yamashita; Kunio Motoyama; Mitsuhiko Fukuda; Yasuzo Matsuo, all of Kyoto, Japan

[73] Assignee: Rohm Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 598,164

[22] Filed: Feb. 7, 1996

[30] Foreign Application Priority Data

Feb. 7, 1995 [JP] Japan ..... 7-018987

[51] Int. Cl.[6] ..... B41J 2/335

[52] U.S. Cl. ..... 347/203; 347/200

[58] Field of Search ..... 347/203, 200

[56] References Cited

U.S. PATENT DOCUMENTS

| | | | |
|---|---|---|---|
| 4,855,757 | 8/1989 | Wiklof et al. | 347/205 |
| 5,374,946 | 12/1994 | Shirakawa | 347/203 |
| 5,485,192 | 1/1996 | Nagahata et al. | 347/203 |

FOREIGN PATENT DOCUMENTS

| | | | |
|---|---|---|---|
| 61-29554 | 2/1986 | Japan | 347/203 |
| 1-283163 | 11/1989 | Japan | 347/203 |
| 5-169699 | 7/1993 | Japan | 347/203 |
| 6-31961 | 2/1994 | Japan | 347/203 |

*Primary Examiner*—Huan H. Tran

*Attorney, Agent, or Firm*—Majestic, Parsons, Siebert & Hsue P.C.

[57] ABSTRACT

A thin-film type thermal print head has a resistor layer formed over an insulative substrate, a conductor layer having a specified planar pattern overlapping the resistor layer, a portion of the resistor layer serving as a heat-emitting part which is not covered by the conductor layer, and a protective layer formed over the heat-emitting part and at least a portion of the conductor layer adjacent to the heat-emitting part. The protective layer may be formed as a conductive layer with resistance greater than that of the heat-emitting part such that static electricity which may be generated by the friction with printing paper can quickly escape to the conductor layer. The protective layer may also include a wear-resisting layer of a prior art type between the conductive layer and the conductor layer, a portion of the conductive layer being preferably connected to the conductor layer. The conductive layer is preferably a mixed layer of SiC and $ZrB_2$ containing $ZrB_2$ by 5–20 molar %, formed by sputtering or chemical vapor deposition and having surface resistance of $10^6$–$10^9\Omega$.

12 Claims, 2 Drawing Sheets

THIN-FILM THERMAL PRINT HEAD AND METHOD OF PRODUCING SAME

BACKGROUND OF THE INVENTION

This invention relates to a thin-film type thermal print head capable of preventing occurrence of defective printing due to a so-called electrostatic breakdown and having heat-emitting parts with improved durability. The invention further relates to a method of producing such a thermal print head.

FIG. 6 shows schematically a heat-emitting part of a prior art thin-film type thermal print head 51, having a local glaze 3 formed on an insulating substrate 2 of alumina ceramic or the like such that pressure concentration on a printing paper is increased and the printing efficiency can be improved. The local glaze 3 is formed by printing and sintering with a glass paste and presents a smooth arcuate cross-sectional shape due to the fluidization of the glass component during the sintering process. A thin-film resistor layer 4 is formed on the surface of the insulating substrate 2 and the local glaze 3, say, by sputtering. Next, a thin-film conductor layer 5 comprising aluminum or the like is formed similarly by a process such as sputtering. This conductor layer 5 is etched by a photo-lithography process such that an area with a specified width of the resistor layer 4 is exposed at a top part of the local glaze 3 to serve as a heat-emitting part 6.

Although not shown in detail in FIG. 6, a planar pattern of a specified shape is formed on the resistor layer 4 and the conductor layer 5 by a photo-lithography process such that the part (5*a*) of the conductor layer 5 on one (right-hand) side of the exposed part of the resistor layer 4 functioning as the heat-emitting part 6 will serve as individual electrodes and the part (5*b*) of the conductor layer 5 on the opposite (left-hand) side will serve as a common electrode.

The surface of the resistor layer 4 and the conductor layer 5, thus formed, is then covered with an anti-oxidative layer 7 and a wear-resisting protective layer 8. The anti-oxidative layer 7 is usually a $SiO_2$ layer formed by sputtering, and the protective layer 8 is usually a $Ta_2O_5$ or $Si_3N_4$ layer formed by sputtering. Each individual electrode is connected, say, by wire bonding to an output pad of a driver IC (not shown), and the common electrode is extended over the insulative substrate 2 and connected to a terminal (not shown).

If any of the individual electrodes 5*a* is switched on, a current flows through the exposed area (the heat-emitting part 6) of the resistor layer 4 sandwiched between the tip of this individual electrode 5*a* and the tip of the common electrode 5*b*, causing heat to be emitted from this part.

With the recent progress in the technologies of semiconductor manufacturing and print head control, however, there is a marked tendency to increase the printing speed by a thermal print head of this type. As a result, problems of the following kind is coming to be considered, in particular regarding thin-film type thermal print heads.

Unlike so-called thick-film type thermal print heads, thin-film type thermal print heads are becoming capable of high-density printing such as 300 dpi, 600 dpi or even greater. For this reason, the conductor layer disposed on the insulative substrate, and more particularly the individual electrodes 5*a*, are formed as a very fine wire pattern. Moreover, the driver ICs to which these individual electrodes are extended at a high density and respectively connected by wire bonding are also formed as a high-density circuit pattern. Thus, the control lines reaching to these individual electrodes and the driver ICs, as well as the heat-emitting parts, have the disadvantage of being very weak against so-called electrostatic breakdown.

With the increase in the printing speed, as explained above, the surfaces of the heat-emitting parts of a thermal print head are contacted by recording paper at a higher speed than before. As a result, the protective layer 8 becomes more easily charged with the static electricity generated by the friction between the protective layer 8 and the recording paper. When the static charge carried by the protective layer reaches a certain level, there takes place an instantaneous discharge between the protective layer 8 and the conductive layer 5. If such a discharge takes place between the protective layer and the common electrode, there is no serious problem but, if it takes place between the protective layer and one of the individual electrodes 5*a*, a portion of the circuit of the corresponding driver IC or heat-emitting part may sustain a damage.

If such an electrostatic breakdown occurs in a driver IC or at a heat-emitting part such that any particular one of the individual electrodes 5*a* becomes inoperable, no heat is emitted from the heat-emitting part corresponding to such an individual electrode, resulting in a defectively printed letter on the recording paper.

SUMMARY OF THE INVENTION

It is therefore a main object of this invention to provide an improved thin-film type thermal print head capable of operating at high printing speed without adversely affecting the quality of printing, preventing printing defects caused by electrostatic breakdown of the kind described above, and having improved durability.

It is another object of this invention to provide a method of producing such a thermal print head.

A thin-film type thermal print head according to this invention, with which the above and other objects can be accomplished, may be characterized as comprising a resistor layer formed over an insulative substrate, a conductor layer having a specified planar pattern overlapping the resistor layer, a portion of the resistor layer serving as a heat-emitting part which is not covered by the conductor layer, and a protective layer formed over the heat-emitting part and at least a portion of the conductor layer adjacent to the heat-emitting part. According to one embodiment of the invention, the protective layer is formed as a conductive layer with resistance greater than that of the heat-emitting part such that static electricity which may be generated by the friction with printing paper can quickly escape to the conductor layer, preventing a build-up of charge within the protective layer which can lead to the destruction of a part of driver IC circuit or the heat-emitting part by its discharge. According to another embodiment of the invention, the protective layer includes a wear-resisting layer of a prior art type and a conductive layer, as described above, formed over it on the exposed surface of the thermal print head. A portion of this conductive layer is preferably connected to the conductor layer and, in particular, the part of the conductor layer serving as a common electrode abutting the heat-emitting part such that not only can the charge build-up in the protective layer be substantially prevented but also the individual electrodes formed by the conductor layer opposite to the common electrode across the heat-emitting part can independently cause the heat-emitting part to be heated.

According to the studies by the present inventors, a mixed layer of SiC and $ZrB_2$ and, in particular, those containing $ZrB_2$ by 5–20 molar %, formed by sputtering or chemical vapor deposition are preferred because such a mixed layer can serve both as a wear-resisting layer and as a conductive layer with surface resistance of $10^6$–$10^9\Omega$.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, those components which are substantially the same, although parts of different thermal print heads, are indicated by the same numeral for convenience.

DETAILED DESCRIPTION OF THE INVENTION

Figure 1:
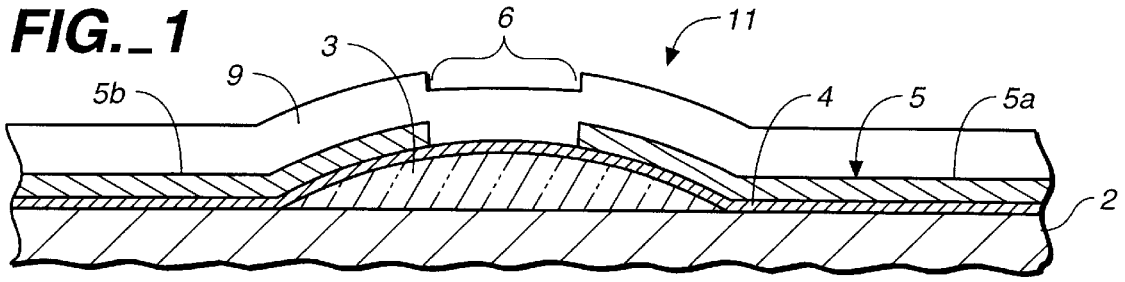
FIG. 1 is a schematic sectional view of a portion of a thin-film type thermal print head embodying this invention.

With reference to FIG. 1, which shows the layer structure near a heat-emitting part of a thin-film type thermal print head 11 embodying this invention, a local glaze 3 is formed by a printing and sintering process using a glass paste on an insulative substrate 2 comprising a material such as alumina ceramic. A resistor layer 4 is formed so as to cover both the insulative substrate 2 and this local glaze 3. This resistor layer 4 may be, for example, a $TaSiO_2$ layer formed by sputtering. A conductor layer 5, for example, of aluminum is formed next also by sputtering. This conductor layer 5 is etched, for example, by a photolithography method such that an area of the resistive layer 4 with a specified width is exposed at a top part of the local glaze 3 to serve as a heat-emitting part 6.

Figure 6:
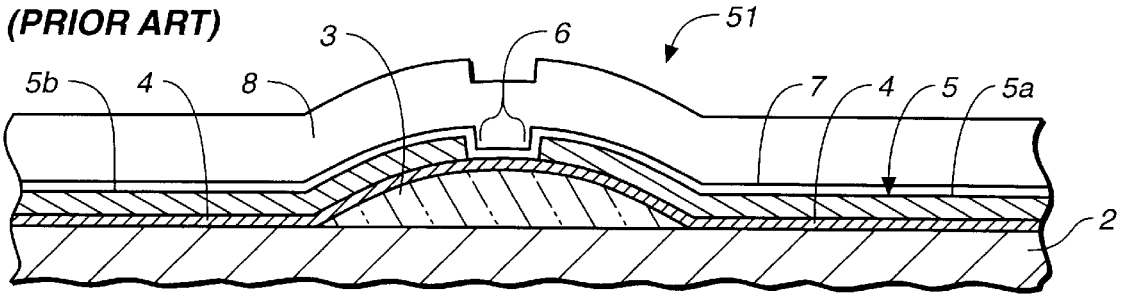
FIG. 6 (PRIOR ART)
FIG. 6 is a schematic sectional view of a portion of a prior art thin-film type thermal print head.

A planar pattern of a specified shape is formed on the resistor layer 4 and the conductor layer such that the part (5*a*) of the conductor layer 5 on one side of the exposed part of the resistor layer 4 functioning as the heat-emitting part 6 will serve as mutually separated individual electrodes and the part (5*b*) of the conductor layer 5 on the opposite side will serve as a common electrode. Each individual electrode 5*a* is connected, say, by wire bonding to an output pad of a driver IC (not shown), and the common electrode 5*b* is extended over the insulative substrate 2 and connected to a terminal (not shown). In other words, the description of the thermal print head 11 given thus far is the same as that for the prior art thermal print head 51 given above with reference to FIG. 6.

The surface of the resistor layer 4 and the conductor layer 5 of the thermal print head 11 according to this invention, however, is covered with a conductive layer 9 having a specified resistance, preferably comprising a mixed layer of SiC and $ZrB_2$ formed by sputtering or chemical vapor deposition (CVD). If this is to be formed by sputtering, a mixed target of SiC and $ZrB_2$ with molar ratio of $ZrB_2$ in the range of 5–20% may be preferably used.

Figure 4:
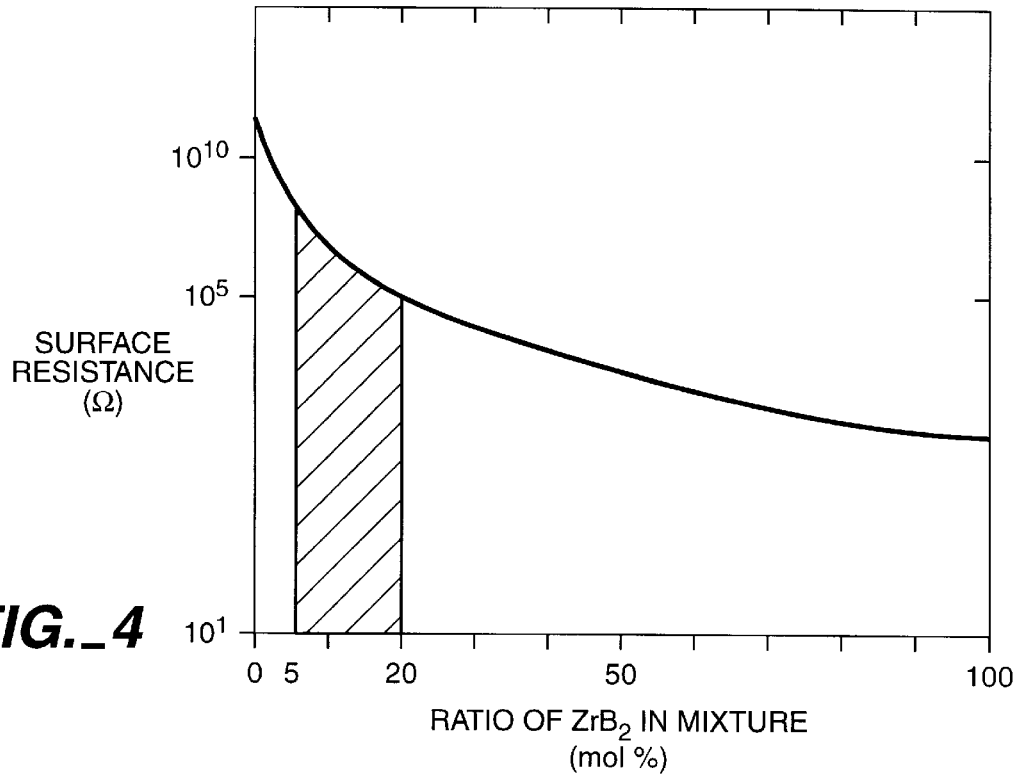
FIG. 4 is a graph of surface resistance characteristics as a function of the ratio of $ZrB_2$ in a mixture of SiC and $ZrB_2$.

The reason for forming the conductive layer 9 as a mixed layer of SiC and $ZrB_2$ is that, as shown in FIG. 4, the surface resistance of such a mixed layer of SiC and $ZrB_2$ decreases monotonically from about $10^{10}\Omega$ as the ratio (in molar %) of $ZrB_2$ in the mixture increases from 0%. For the purpose of the present invention, however, the resistance of this conductive layer 9 is desired to be greater than that of the heat-emitting part 6, and preferably equal to about $10^6$–$10^9\Omega$, and such a resistance value can be given to the mixture of SiC and $ZrB_2$ if the molar ratio of $ZrB_2$ therein is in the range of 5–20%. In fact, it has been experimentally ascertained that the surface hardness of such a mixed layer with the molar ratio of $ZrB_2$ in this range is better by 10–20% than that of protective layers of $Ta_2O_5$ or $Si_3N_4$ of prior art thin-film type thermal print heads.

With reference to FIG. 1, the thickness of the resistor layer 4 is preferably 0.01–0.2 $\mu$m, that of the conductor layer 5 is preferably 1–2 $\mu$m, and that of the conductive layer 9 comprising the mixture of SiC and $ZrB_2$ is preferably 3–6 $\mu$m, but these ranges are not intended to limit the scope of this invention. Instead, the thin-film type thermal print head 11 described above may be characterized as having a conductive layer which both functions as a protective layer and is adapted to directly come into contact with a recording paper. As a result, even if more static electricity may be generated by friction with the recording paper as the printing speed is increased, the generated electrostatic charge can immediately conducted out through this conductive layer, without causing any instantaneous discharge and thereby destroying parts of circuits in the driver ICs or the heat-emitting parts. This serves to prevent substantially entirely the occurrence of defective printing on the recording paper.

Since the conductive layer 9 takes the place of the protective layer of prior art thermal print head, static electricity can freely escape downward to the conductor layer below while, since its surface resistance of $10^6$–$10^9\Omega$ is greater than that of the heat-emitting part 6, the presence of this conductive layer 9 does not impede the heating of the individual heat-emitting parts 6. Moreover, the conductive layer 9 according to this embodiment of the invention has the additional advantage that its surface hardness can be improved over that of the protective layers of prior art thermal print heads. Thus, thin-film type thermal print heads according to this invention has improved durability and prevents more effectively the occurrence of defective printing.

Figure 2:
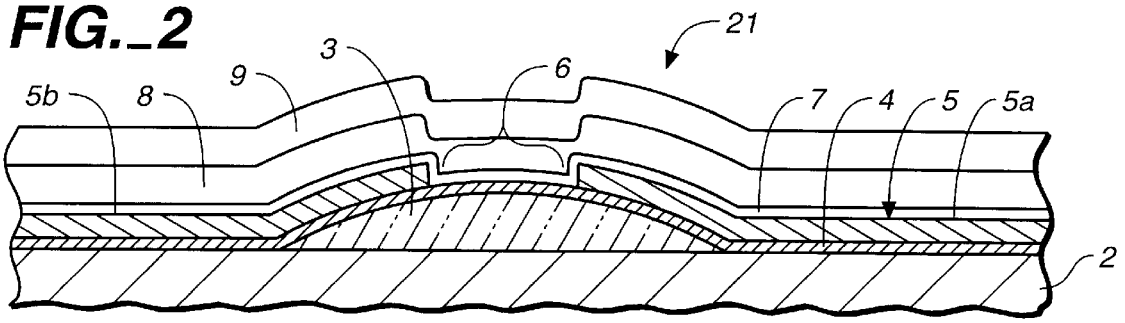
FIG. 2 is a schematic sectional view of a portion of another thin-film type thermal print head embodying this invention.

FIG. 2 (wherein layers which are substantially the same as those shown in FIG. 1 are indicated by the same numerals) shows a portion of another thin-film type thermal print head 21 embodying this invention, which is similar to the prior art thermal print head 51 described above with reference to FIG. 6 but is different therefrom in that a conductive layer 9, as described above with reference to FIG. 1, is formed over the protective layer 8. As explained with reference to FIG. 1, the conductive layer 9 of FIG. 2, too, is preferably a mixed layer of SiC and $ZrB_2$ formed by sputtering or CVD, the ratio of $ZrB_2$ in the mixture being 5–20 molar % for the same reason as given above for the thermal print head 11 according to the first embodiment of the invention. It is further preferable to electrically connect the conductive layer 9 to a grounding terminal or a common electrode terminal (not shown) which may be formed at a suitable position on the insulative substrate 2. Preferred ranges of thickness of various layers shown in FIG. 2 are 0.01–0.2 $\mu$m for the resistor layer 4, 1–2 $\mu$m for the conductor layer 5, 0.5–1.5 $\mu$m for the anti-oxidation layer 7, 3–6 $\mu$m for the wear-resisting protective layer 8, and 2–3 $\mu$m for the conductive layer 9, but these preferred ranges are not intended to limit the scope of the invention. It should be clear to the reader that thermal print heads according to the second embodiment of the invention also enjoy the same advantages of the thermal print heads according to the first embodiment of the invention discussed above.

Figure 3:
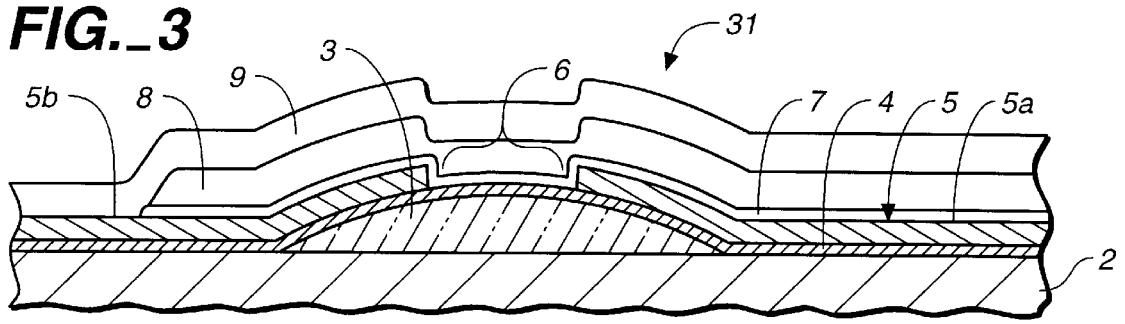
FIG. 3 is a schematic sectional view of a portion of still another thin-film type thermal print head embodying this invention.

FIG. 3 (wherein layers which are substantially the same as those shown in FIGS. 1 and 2 are again indicated by the same numerals) shows still another thin-film type thermal print head 31, which is similar to and hence may be considered a variation of the thermal print head 21 shown in FIG. 2 but is different therefrom in that the outermost conductive layer 9 is directly connected to a portion of the conductive layer on the side functioning as the common electrode 5*b*, not on the side of the individual electrodes 5*a*. This direct connection of the common electrode 5*b* to the conductive layer 9 has the advantage of further reducing the adverse effects of static electricity on the driver ICs through the individual electrodes. It again goes without saying that the thermal print head 31 of FIG. 3 also enjoys all the other advantages of the thermal print heads described above.

Figure 5:
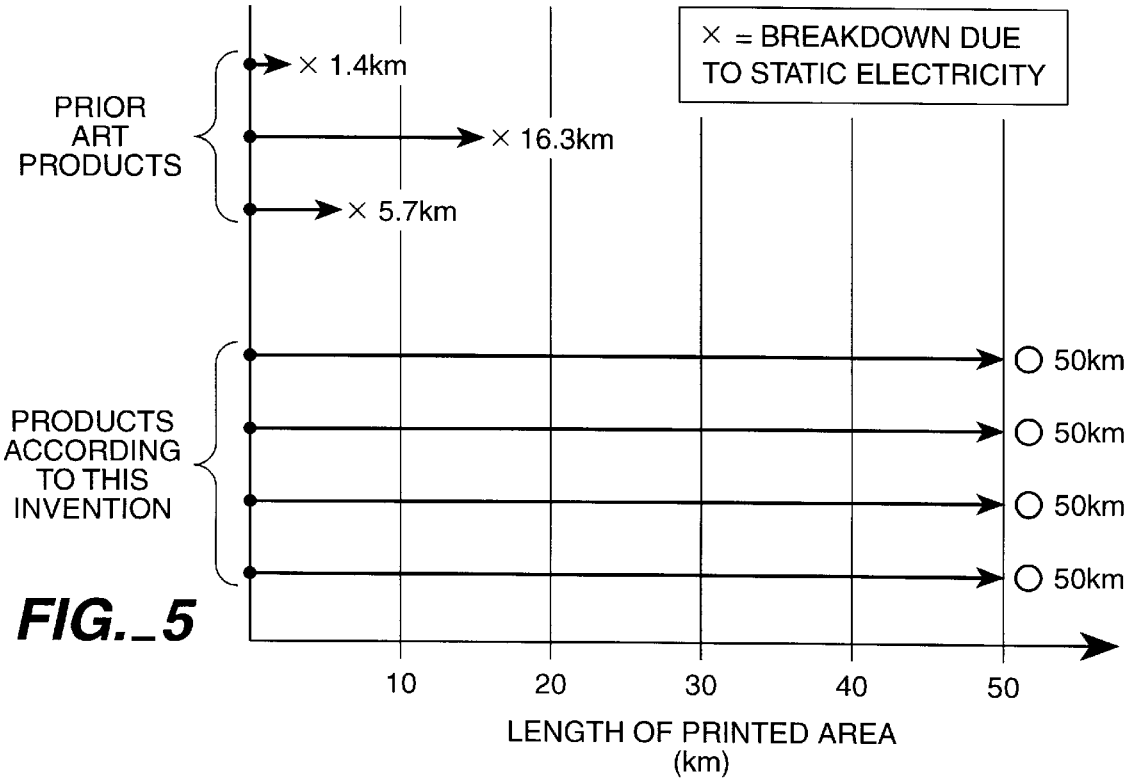
FIG. 5 is a graph for schematically showing the results of a test for comparing the capability of prior art print heads and print heads according to this invention.

Four thin-film type thermal print heads as described above with reference to FIG. 3 and three randomly selected prior art thermal print heads were used and compared in a series of printing tests involving continuous black printing at the printing speed of 6 inches/second. For each of these thermal print heads, the length of the printed area by such a continuous printing test was measured before the first occurrence of a white void considered to be caused by an electrostatic breakdown. As schematically shown in FIG. 5, the length was less than 20 km by any of the three prior art print heads but all of the four tested print heads embodying this invention could print over an area with length of 50 km without a defect.

What is claimed is:

1. A thin-film type thermal print head comprising:

an insulative substrate;

a resistor layer formed over said substrate;

a conductor layer having a specified planar pattern overlapping said resistor layer, a portion of said resistor layer being a heat-emitting part which is not covered by said conductor layer; and a protective layer formed over said heat-emitting part and at least a portion of said conductor layer adjacent said heat-emitting part, said protective layer having an externally exposed surface opposite said conductor layer, said protective layer comprising a conductive layer consisting of SiC and $ZrB_2$ at said externally exposed surface.

2. The thermal print head of claim 1 wherein said conductive layer contains $ZrB_2$ by 5–20 molar %.

3. The thermal print head of claim 1 wherein said conductive layer is a sputtered layer.

4. The thermal print head of claim 1 wherein said conductive layer is a chemically vapor-deposited layer.

5. A thin-film type thermal print head comprising:

an insulative substrate;

a resistor layer formed over said substrate;

a conductor layer having a specified planar pattern overlapping said resistor layer, a portion of said resistor layer being a heat-emitting part which is not covered by said conductor layer;

a protective layer formed over said heat-emitting part and at least a portion of said conductor layer adjacent said heat-emitting part; and a conductive layer consisting of SiC and $ZrB_2$ over said protective layer.

6. The thin-film type thermal print head of claim 5 wherein said conductive layer has a contacting part which is in contact with said conductor layer.

7. The thermal print head of claim 5 wherein said conductive layer contains $ZrB_2$ by 5–20 molar %.

8. The thermal print head of claim 6 wherein said conductive layer contains $ZrB_2$ by 5–20 molar %.

9. The thermal print head of claim 5 wherein said conductive layer is a sputtered layer.

10. The thermal print head of claim 5 wherein said conductive layer is a chemically vapor-deposited layer.

11. The thermal print head of claim 6 wherein said conductive layer is a sputtered layer.

12. The thermal print head of claim 6 wherein said conductive layer is a chemically vapor-deposited layer.

* * * * *